US005222534A

United States Patent [19]

Wilkinson, Jr.

[11] Patent Number: 5,222,534

[45] Date of Patent: Jun. 29, 1993

[54] CONTAINER RESTRAINT OR HOLDER

[76] Inventor: Charles E. Wilkinson, Jr., 3340 Loyola Ct., Boulder, Colo. 80303

[21] Appl. No.: 937,553

[22] Filed: Aug. 31, 1992

[51] Int. Cl.[5] ..... B65B 3/04; B67C 3/02

[52] U.S. Cl. ..... 141/88; 141/86; 141/311 A; 141/378; 220/573; 220/737; 248/519

[58] Field of Search ..... 141/86, 88, 106, 311 A, 141/378; 220/573, 572, 571, 506, 737, 908; 224/42.42; 206/223; 99/444, 446, 426; 248/519, 523, 524

[56] References Cited

U.S. PATENT DOCUMENTS

| | | | |
|---|---|---|---|
| 401,487 | 4/1889 | Ellis | 141/88 |
| 820,353 | 5/1906 | Epperson | 141/95 |
| 953,065 | 3/1910 | Smith | 210/86 |
| 1,290,968 | 1/1919 | Gillette | 141/95 |
| 1,333,756 | 3/1920 | Heimgartner | 141/95 |
| 2,014,108 | 9/1935 | Hawke | 294/31.2 |
| 2,715,488 | 6/1952 | Conlon | 141/95 |
| 4,332,282 | 8/1983 | Strange | 141/1 |
| 4,637,303 | 1/1987 | Lucky | 99/426 |
| 4,697,670 | 10/1987 | Arruda | 184/1.5 |
| 4,756,411 | 7/1988 | Garland | 220/573 |
| 4,967,508 | 11/1990 | Reynolds | 248/523 |

*Primary Examiner*—Henry J. Recla
*Assistant Examiner*—Steven O. Douglas
*Attorney, Agent, or Firm*—H. Kenneth Johnston, II

[57] ABSTRACT

A device for the retention of various sizes of containers used in the collection of waste fluids such as anti-freeze, oil and other liquids including a receptacle with a raised platform for supporting a container to be filled and a trough surrounding the raised platform for collecting spilled fluids. The raised platform having a plurality of peg receptacles each capable of receiving a peg for providing support to the container being filled. Drain channels are provided between the peg receptacles and the trough permitting spilled fluids to drain into the trough and providing structural support to the device.

5 Claims, 3 Drawing Sheets

CONTAINER RESTRAINT OR HOLDER

BACKGROUND AND OBJECTS OF THE INVENTION

This invention relates to a device for the retention of various sized containers while being refilled with waste or other types of liquids. Waste products from motor vehicles can no longer be merely disposed of by draining on the ground and because of various regulations require disposal in containers for recycling of the product such as oil. Changing oil or changing the fluid in a radiator in a motor vehicle has always been a messy job however due to the prohibitions on disposal it has become substantially worse. Now individuals are required to put the used or waste product into some type of container in order to be able to take the waste to a proper disposal site. This has created a substantial mess in the past trying to pour the waste product back into some container for transport. For example, the plastic oil containers when empty are extremely light and are easily knocked over and are troublesome when trying to put any type of liquid back into the container. Most of the time the container requires someone to hold it while the waste product is being poured into it. This in many cased necessitates two people to do the job and the individual holding the container many times ends up with the waste product all over his hands or even on his clothes. There are various funnel devices to attempt to remedy the problem, some which only dispense a specified volume, some which have shut off devices to stop the flow of liquid when the container gets full such as shown in Epperson, U.S. Pat. No. 820,353, Heimgartner, U.S. Pat. No. 1,333,756, Gillette, U.S. Pat. No. 1,290,968, Smith, U.S. Pat. No. 953,065, Conlon U.S. Pat. No. 2,715,488, and a more recent device shown by Strange in U.S. Pat. No. B1 4,332,282 for returning crankcase oil to oil cans which have just been emptied of new oil. Strange suggests that his device must have legs otherwise naturally someone is going to have to hold the container while it is draining. Filling an emptied plastic oil bottle,(which come in various shaped quart sizes) a anti-freeze gallon jug, or an empty milk bottle is difficult to do with out the mess of accidently tipping the container over unless someone is assisting during the refilling process. More than likely a person is not going to have someone there to help in changing the oil just to have them hold the container to refill it with the waste material and even if they do, then who has to get messy is always an interesting discussion. Although no device will preclude an individual from getting their hands dirty, the present invention provides a device which solves the time old problem of getting the waste material back into a container for transport to a disposal site without having a mess all over the garage, backyard or another individual. The present invention is economical, light weight, and generally eliminates the mess incurred when refilling a container. The objects stated above and other objects of the invention are accomplished by a container restraining device comprising a receptacle having a raised platform, with a plurality of peg receptacles capable of receiving a plurality of pegs for restraining a container thereon, having a trough surrounding the raised platform with a outer portion of the trough extending vertically above the raised platform preventing any spilled material from running over on to the floor or other unwanted area and retaining the spillage within the trough which can then be poured back into the container being used to fill the container being refilled. For example, plastic oil containers come in various sizes, such as the round Quaker State®, the rectangular Pennzoil®, and the nearly square Castrol® bottles. Most of the anti-freeze containers are the same shape as are most of the gallon milk jugs. However each pose a similar problem when trying to refill them, they are light and easily tip over. The within device eliminates this by securing each of the different bottles on to the raised platform by placing a plurality of pegs at different positions on the raised platform in the peg receptacles and thus preventing the bottle from tipping over and dumping the contents. Each different shaped bottle is secured using a different group of peg receptacles.

DETAILED DESCRIPTION OF THE PREFERRED EMBODIMENT

Figure 1:
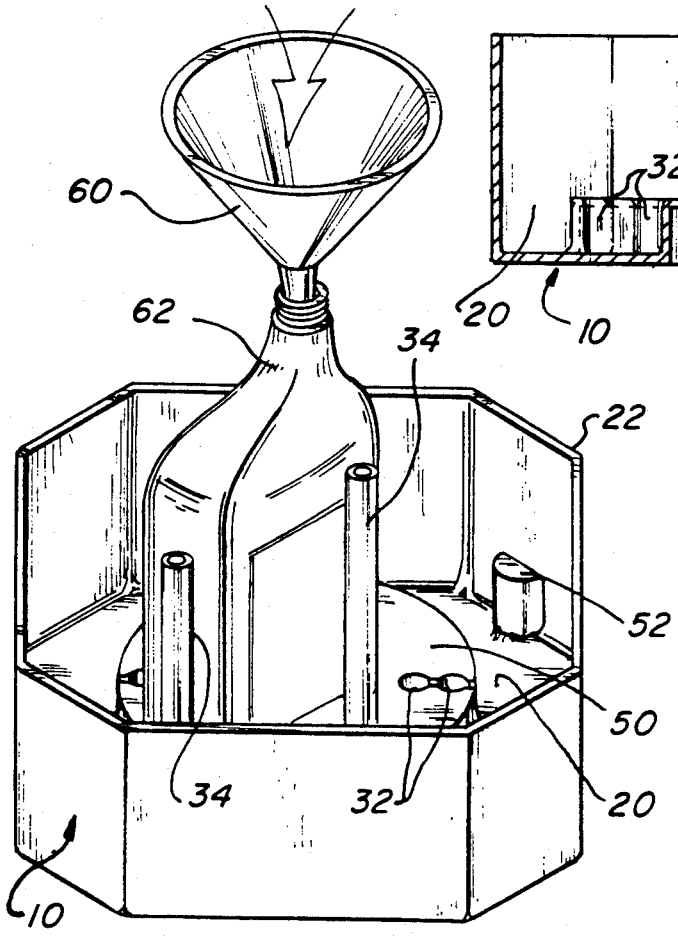
FIG. 1 is a perspective drawing of the retention device with a rectangular container held in place for filling.
Figure 3:
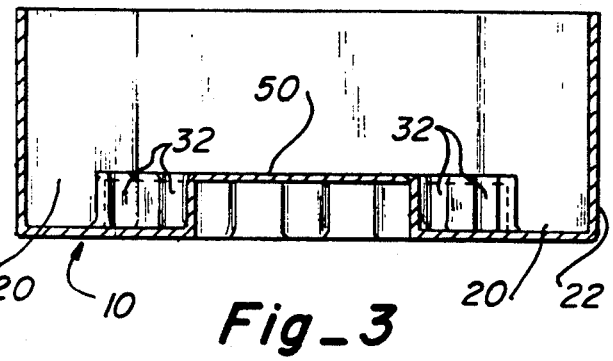
FIG. 3 is a section taken along the lines 3—3 of FIG. 2.
Figure 4:
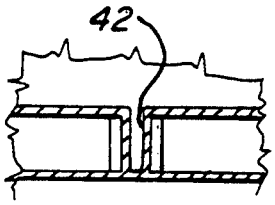
FIG. 4 is a cross-sectional view of the drain channel taken along the lines 4—4 of FIG. 2.
Figure 2:
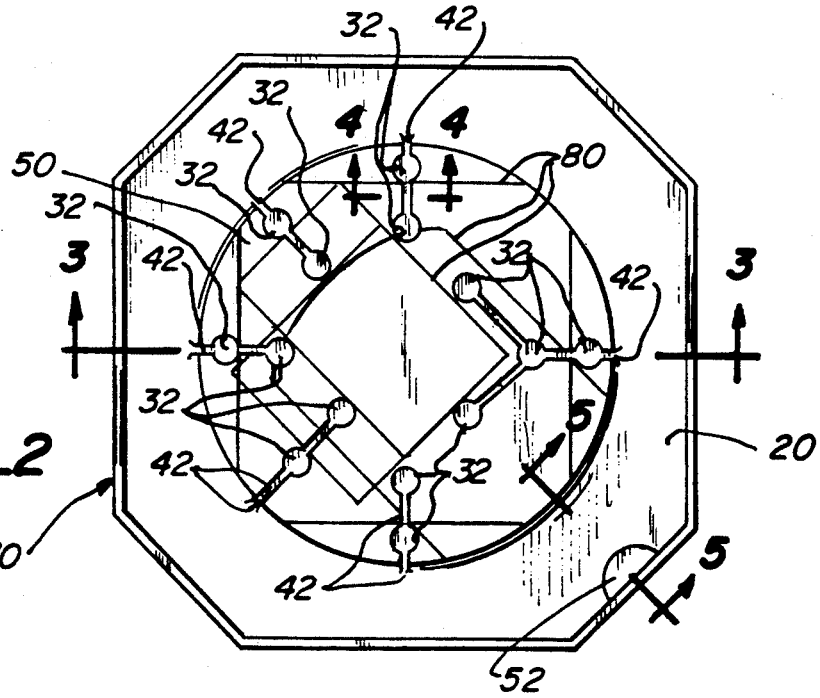
FIG. 2 is a top elevation showing the plurality of peg receptacles.
Figure 5:
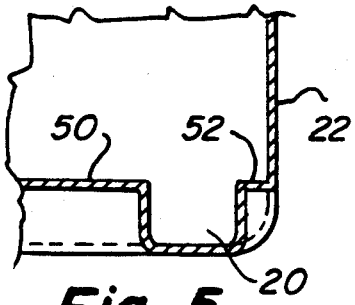
FIG. 5 is a cross-sectional view of the pedestal and raised platform taken along the lines 5—5 of FIG. 2.
Figure 6:
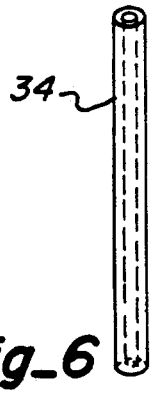
FIG. 6 is a perspective view of a peg.
Figure 9:
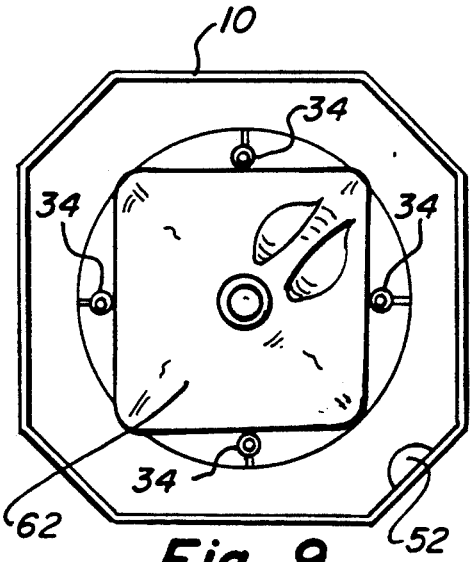
FIG. 9 is a top view of the retention device with a one gallon milk jug being held in place.
Figure 7:
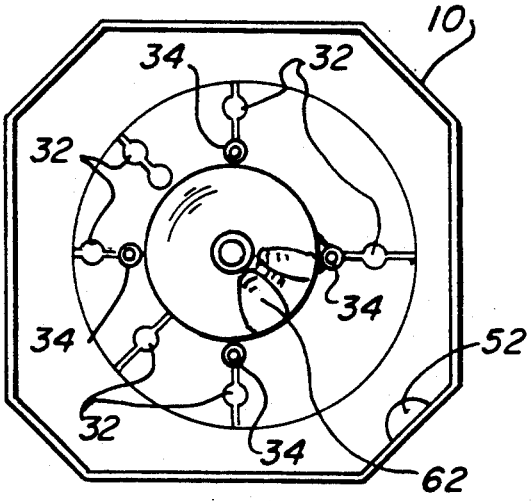
FIG. 7 is a top view of the retention device with a round container being held in place.
Figure 10:
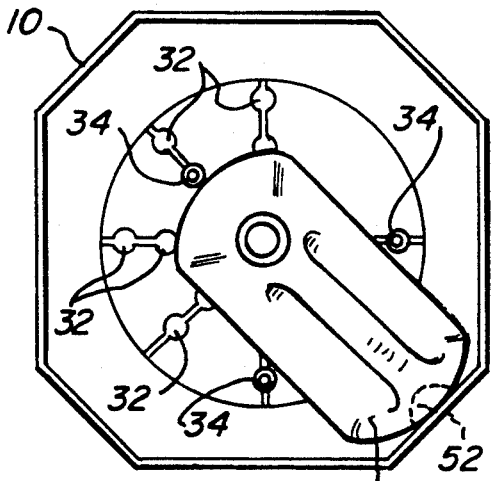
FIG. 10 is a top view of the retention device with a anti-freeze container being held in place.
Figure 12:
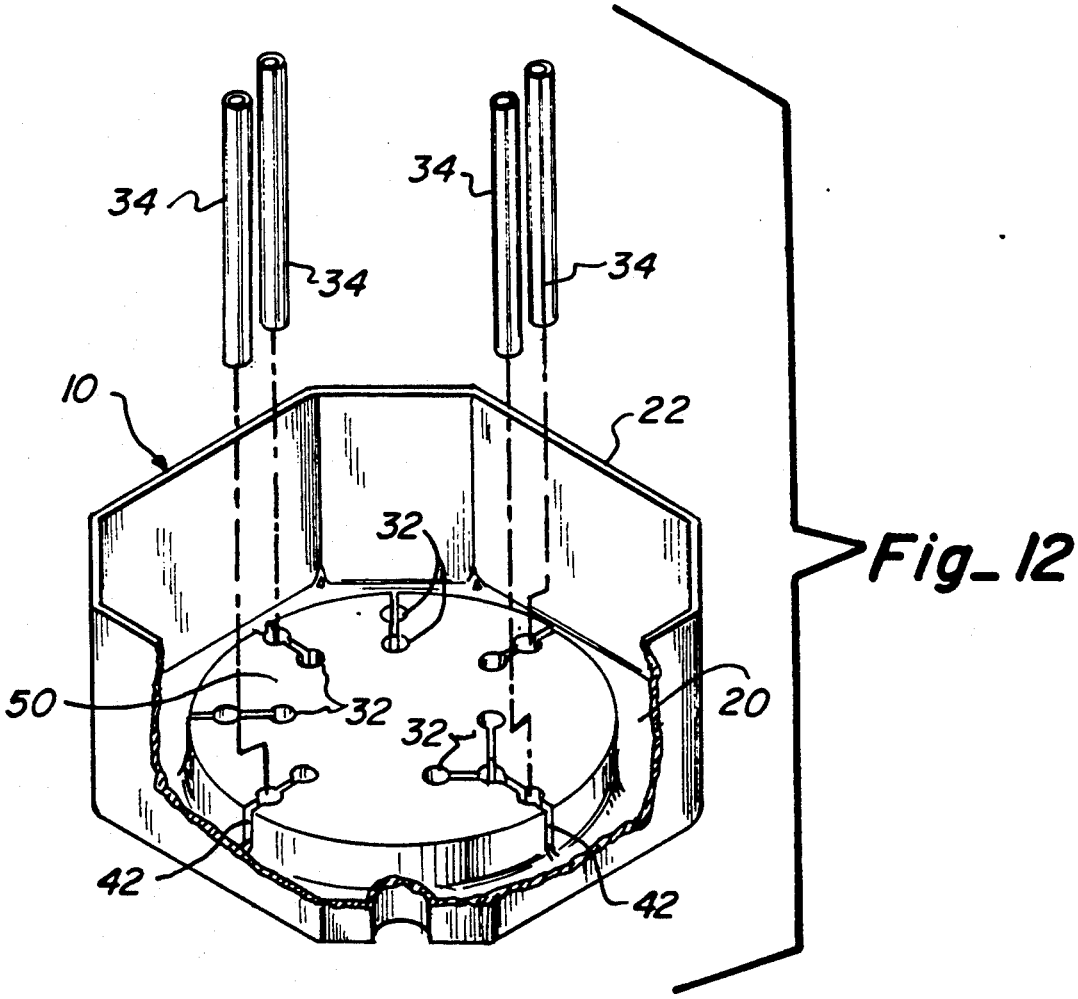
FIG. 12 is a cross-sectional view of the retention device showing placement of the pegs to the peg receptacles.

The overall construction of the retention device 10 of the present invention is best shown in FIGS. 1 and 12 of the drawings wherein a container 62 to be refilled is placed on the raised platform 50 and is secured in place by a plurality of pegs 34 placed in separate peg receptacles 32 in a manner that the container 62 will not tip over when funnel 60 is placed in the open end of the container 62 and is filled with fluid as shown by the arrow in FIG. 1. The retention device 10 has a trough 20 separating the raised platform 50 and the wall 22 which extends vertically above the height of the raised platform 50 in order that any fluid which may have been spilled while filling the container 62 is retained within trough 20. After the container 62 is filled it is removed from the retention device 10 and wiped clean if necessary and the lid (not shown) is replaced on the container 62 and is ready to be returned to a recycling center without the concern of waste fluid slopping around in a oil pan or the like in ones vehicle. The raised platform 50 has a plurality of peg receptacles 32 each capable of receiving a peg 34. As shown in FIGS. 7, 8, 9, 10, and 11 peg receptacle 32 are arranged in a manner that a minimum number of pegs 34 are utilized to secure upright the container 62 whether it be a round container, a rectangular container, a milk jug, a anti-freeze container or a substantially square container respectively. Additionally, a pedestal 52 being the same height as the raised platform 50 as shown in FIG. 5 is provided in order to provide additional support when the anti-freeze container is being filled as shown in FIG. 10. As shown in FIG. 6, peg 34 may be hollow and is sufficiently long (approximately 6 inches) to adequately secure the container. The wall 22 as shown in FIG. 3 extends substantially above the raised platform 50 in order that the retention device may be used as a drain container as many times individuals do not have a container that will fit under a motor vehicle. Although the wall 22 extension is preferred, the wall 22 height need be only sufficient to permit spillage to be collected in trough 20. All of the peg receptacles 32 are interconnected with drain channels 42 in a manner that allows spillage collected in peg receptacles 32 which do not have a peg 34 in them to drain the spilled material into the trough 20 as shown in FIGS. 2 and 3. Drain channel 42 in addition to providing the draining of spillage, provides additional rigidity to the retention device 10 when vacuum formed or manufactured using a thin wall flexible material.

Figure 8:
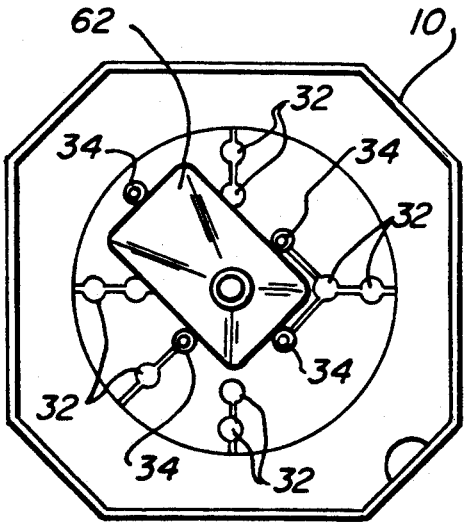
FIG. 8 is a top view of the retention device with a rectangular container being held in place.
Figure 11:
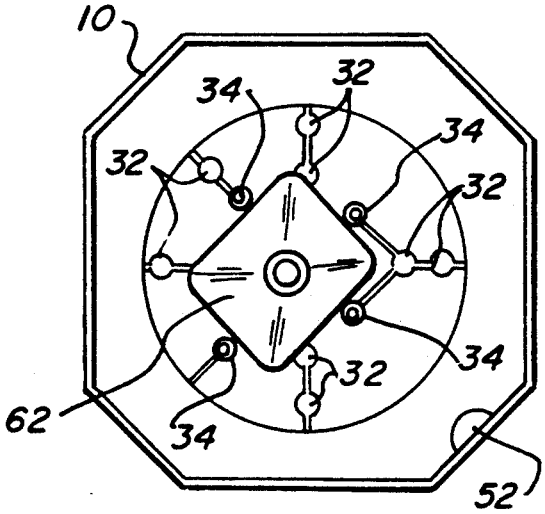
FIG. 11 is a top view of the retention device with a nearly square container being held in place.

In operation, a empty container 62 such as a rectangular plastic oil container is placed on the raised platform 50 as shown in FIG. 8 and a plurality of peg 34 are individually placed in separate peg receptacle 32 so that the empty container 62 is held in a manner that it will not tip over when funnel 60 is placed in the opening and fluid is poured into and filling the container 62.

For the ease of placement of the peg 34 in peg receptacle 32 for a specific empty container 62, the outline 80 of each size container is affixed to the raised platform 50 as shown in FIG. 2.

The FIG. 2 of the drawings have been amended to reflect the outline 80 above.

It may thus be apparent from the above description that the device of the present has utility in various modes of use and with convenience not achievable by prior art devices.

While there is shown and described herein certain specific structure embodying this invention, it will be obvious to one skilled in the art that various modifications such as elimination of the drain channel 42 or height reduction of wall 22, addition of peg receptacles to accommodate other containers as well as other modifications may be made without deviating from the spirit and scope of the underlying inventive concept and that the same is not limited to the particular form herein shown and described except insofar as indicated by the scope of the claims hereinafter.

What is claimed:

1. A retention device for holding empty containers during the refilling of waste or other fluids comprising:

a raised platform means;

said raised platform means continuously encompassed by a trough means capable of containing spilled materials therein;

said raised platform means having a plurality of peg receptacle means each capable of receiving a peg means;

said peg means sufficiently long to retain said container in the upright position;

said peg receptacle means interconnected to said trough means by a drain means for draining spilled materials into said trough means from said peg receptacle means;

whereby when said container is placed on said raised platform means and retained by insertion of said peg means into said peg receptacle means said container may be easily supported for refilling.

2. A retention device for holding empty containers of varying size during the refilling of waste or other fluids into said containers comprising:

a housing having a floor and sidewalls completely surrounding said floor;

a raised platform means within said housing for supporting an empty container thereon;

a trough means around said platform means defined by said housing and said platform means and capable of containing spilled materials therein;

said raised platform means having a plurality of peg receptacle means therein, said receptacle means being located to be adjacent a selected container;

a plurality of peg means removably received in selected ones of said receptacle means to hold a selected empty container upright during refilling.

3. The device of claim 2, said peg receptacle means including a drain channel means extending to said trough means for draining material spilled into said peg receptacle means.

4. The device of claim 2, said raised platform means including outlines of said containers for ease of placement of said containers and said pegs.

5. The device of claim 2, said trough means including a pedestal means for support of one side of a container having lateral dimension greater than a container dimensioned to fit entirely on said platform means.

* * * * *